United States Patent [19]

Sugimoto et al.

[11] 4,385,684

[45] May 31, 1983

[54] COIN SELECTION DEVICE

[75] Inventors: Osamu Sugimoto, Sakado; Masayoshi Takizawa, Kitamoto, both of Japan

[73] Assignee: Kabushiki Kaisha Nippon Coinco, Tokyo, Japan

[21] Appl. No.: 167,549

[22] Filed: Jul. 10, 1980

[30] Foreign Application Priority Data

Jul. 17, 1979 [JP] Japan ..... 54-98188[U]
Jul. 17, 1979 [JP] Japan ..... 54-98189[U]

[51] Int. Cl.³ ..... G07D 5/08
[52] U.S. Cl. ..... 194/100 A
[58] Field of Search ..... 194/99, 100 R, 100 A, 194/102; 73/163

[56] References Cited

U.S. PATENT DOCUMENTS 3,682,286 8/1972 Prumm ..... 194/100 A

*Primary Examiner*—Robert B. Reeves
*Assistant Examiner*—Edward M. Wacyra
*Attorney, Agent, or Firm*—Holman & Stern

[57] ABSTRACT

A coin selection device is of a type in which reference voltage is automatically adjusted in accordance with variation in the output level of a receiving coil in a standby mode. A oscillating coil and a receiving coil are disposed on both sides of a coin path. A peak of output level of the receiving coil and the reference voltage are compared each other in a comparator for detecting whether inserted coin is true or false. The output level of the receiving coil in the standby mode is stored so that variations in temperature and circuit parameters can be taken into account in the reference voltage level.

5 Claims, 3 Drawing Figures

K
49
48
KA
KB
KC
50
40
41
42
43
44
45
46
47
VRA1
VRA2
VRB1
VRB2
R1
R2
R3
R4
R5
R6
VPA
VRA
VPB
VRB
37
38
RE
29
30
31
32
33
34
35
36
39
21
22
23
24
25
26
27
PEAK
V1
V2
VPB
VB'
28
19
20
VB
11b
12b
12
11
11a
12a
17
18
54
60
61
R7
C1
T2C
56
55
T2
SOL
53
T1
S
52
57
51
K
62
63
64
T
C2
T1C
R8
59
58
RE

COIN SELECTION DEVICE

BACKGROUND OF THE INVENTION

This invention relates to an electronic coin selection device employing coils for discriminating true coins from false or counterfeit coins.

Important problems to be solved in an electronic coin selection device employing coils are:

(1) How to improve accuracy in detection by the coils; and (2) How to ensure sorting of a coin to be accepted and a coin to be returned.

In prior art electronic coin selection devices employing coils, a coin discrimination output is obtained by detecting and amplifying an output of a receiving coil and then comparing this output with a reference voltage. Irregularity however occurs in the output of a detection and amplification circuit due to variation in the amplification characteristic caused by change in temperature of the circuit, errors in assembling of the circuit, variation in power voltage for an oscillation source and other causes. This irregularity adversely affects the accuracy in discrimination of coins by the coin selection device.

Sorting of coins into coins to be accepted and coins to be returned is effected at a coin sorting point in response to the coin discrimination output of the detection and amplification circuit. An erroneous operation in the sorting of coins tends to take place in a case where true coins and false coins are deposited in succession at extremely short intervals. If true coins and false coins are deposited in the coin slot in rapid succession, true coins and false coins must be sorted out in extremely short time frames. This causes an error in timing, resulting in erroneous operation such that a false coin is accepted and a true coin is returned.

SUMMARY OF THE INVENTION

It is an object of the present invention to provide a coin selection device which overcomes the above described two problems.

According to the invention, reference voltages, used for a comparison circuit evaluating the output of a detection and amplification circuit, are automatically adjusted in accordance with variation in the output level in a standby mode (a state in which a coin has not passed the coin detection device yet). This arrangement eliminates the adverse effect of the variation in the detection and amplification circuit characteristics and improves the detection accuracy by the coin selection device.

According to the invention, the coin selection device always is ready to accept a coin in a standby mode, accepts an inserted coin if it has been judged to be a true coin, and is shifted to a coin return mode for a specific period of time if the inserted coin has been judged to be a false coin. If a coin is inserted in the coin return mode, the period of time during which the coin is returned is renewed and the coin return mode is thereby sustained. Accordingly, if coins are successively inserted at a short interval after a false coin, all coins are returned whether they are true or false. The erroneous operation of accepting a false coin and returning a true coin can therefore be eliminated. If true coins only are successively inserted, they are all accepted so that the efficiency of the coin selection device can be remarkably improved.

BRIEF DESCRIPTION OF DRAWINGS

In the accompanying drawings.

DESCRIPTION OF A PREFERRED EMBODIMENT

Figure 1:
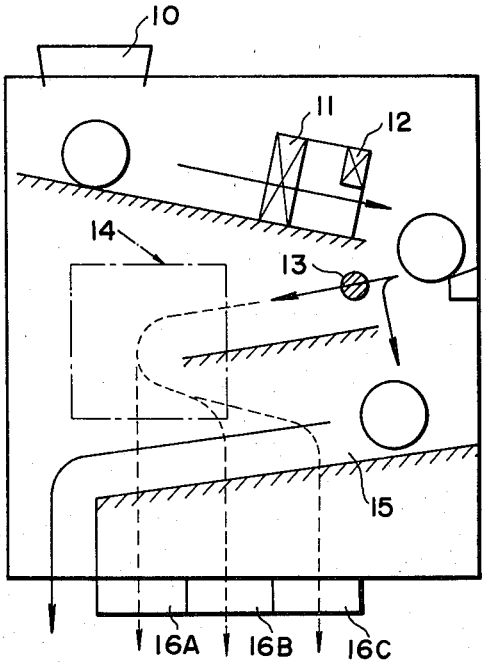
FIG. 1 is a sectional view schematically showing a coin device to which the coin selection device according to the invention is applied.

Referring first to FIG. 1, a coin path coin inserted from a coin slot 10 passes through coil type coin selection devices 11 and 12. If the inserted coin has been judged by these coin selection devices 11 and 12 to be a true coin, the coin is led to a coin sorting device 14 with a pin 13 remaining withdrawn at a coin path turning point. If the inserted coin has been judged to be a false coin, the pin 13 is caused to project into the coin path to block the coin and let it fall into a return path 15. The coin sorting device 14 sorts out coins mechanically by denomination on the basis of differences in the coin diameter. The sorted out coins are accepted in coin boxes (not shown) provided for respective denominations. Coin sensors 16A, 16B and 16C for respective denominations are provided in paths from the coin sorting device 14 to the respective coin boxes. These coin sensors 16A, 16B and 16C, respectively, produces coin detection pulses when corresponding coins, having been sorted by the coin sorting device 14, pass by the sensors. The coin detection pulses are counted by a counter (not shown) whereby the number of the inserted coins (or the sum of the value of the inserted coins) is counted. The outputs of the coin selection devices 11, 12 are utilized for actuating the pin 13 but not for counting by the counter.

The coin selection device 11, consisting of an oscillating coil **11*a* and a receiving coil 11*b* (FIG. 2) which are large enough to reach the entire diameter of the inserted coins, mainly participate in discrimination of the material of the coins. The coin selection device 12, consisting of an oscillating coil 12*a* and a receiving coil 12*b* (FIG. 2) which are of a smaller size than the coin selection device 11** and are provided in the vicinity of the upper edge of the coin path, participate mainly in discrimination of the coin diameter.

Figure 2:
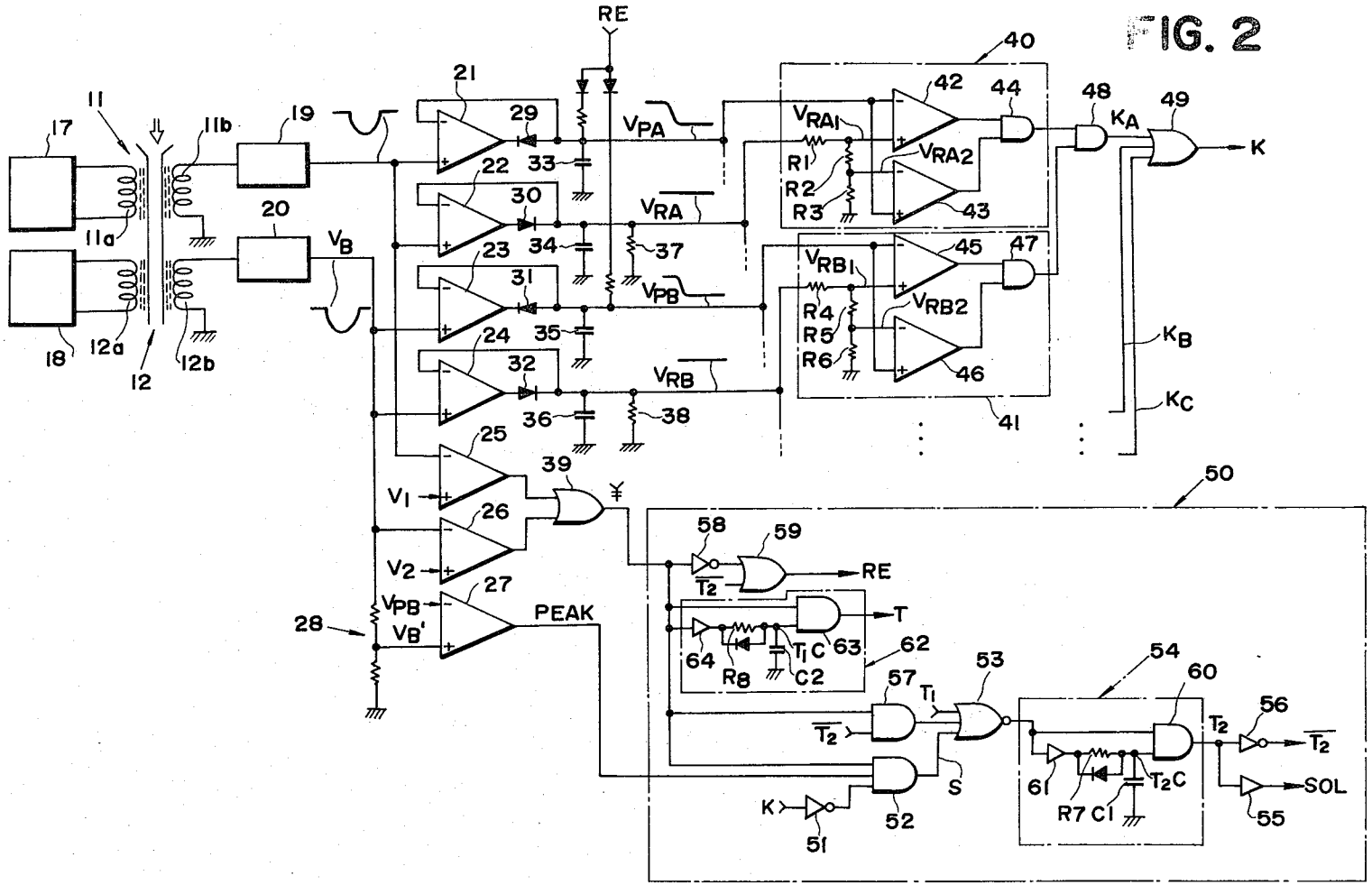
FIG. 2 is a circuit diagram showing an embodiment of the invention.

An example of a circuit which produces, in response to the outputs of the coin selection devices 11 and 12, a signal SOL for controlling the actuation of the pin 13 is shown in FIG. 2.

In FIG. 2, an oscillation circuit 17 generates a signal of a frequency suitable for the discrimination of the material of the coin (e.g. about 10 kHz). The output of this oscillation circuit 17 is applied to the oscillation coil **11*a*. An oscillating circuit 18 generates a signal of a high frequency (e.g. about 100 kHz) suitable for discriminating the coin diameter. The output of the oscillating circuit 18 is applied to the oscillating coil 12*a*. The output of the receiving coil 11*b* is applied to amplifiers 21 and 22 and a comparator 25 through a detection and amplification circuit 19. The output of the receiving coil 12*b* is applied to amplifiers 23 and 24 and a comparator 26 through a detection and amplification circuit 20. The output of the receiving coil 12*b* is also applied to a comparator 27 after it is shifted in its level by a voltage dividing circuit 28**.

The outputs of the detection and amplification circuits 19 and 20, i.e., received signal outputs, are of a definite waveform of a high level in a standby mode, i.e., when no coin is passing, whereas they become attenuated waveforms of a V shape in response to the material or diameter of an inserted coin when the coin passes by the coin selection device 11 or 12. The amplifier 21, a diode 29 connected in a reverse direction to the output of the amplifier 21 and a capacitor 33 constitute a circuit which stores the lowest level, i.e., the peak value of the attenuated waveform. When a voltage lower than voltage across the capacitor 33 appears at the output of the amplifier 21, the diode 29 is brought into conduction and the voltage acrosss the capacitor 33 thereby is maintained always at the lowest level. The amplifier 23, a diode 31 and a capacitor 35 likewise constitute a lowest level (peak level) memory circuit. The amplifier 22, a diode 30 connected in a forward direction to the amplifier 22, a capacitor 34 and resistance 37 for discharging constitute a circuit for storing a constant voltage value in the standby mode. More specifically, when voltage higher than voltage across the capacitor 34 appears at the output of the amplifier 22, the diode 30 is brought into conduction to charge the capacitor 34. When the output of the amplifier 22 is lower than the voltage across the capacitor 34, the capacitor 34 discharges through the resistance 37 until the voltage across the capacitor 33 becomes equal to the output level of the amplifier 22. This discharging scarcely responds to drop in the level of a received signal which occurs instantaneously when a coin passes. Accordingly, a constant voltage in the standby mode is always stored in the capacitor 34. A circuit consisting of the amplifier 24, a diode 32, a capacitor 36 and resistance 38 likewise constitutes a circuit storing a constant level in the standby mode. Whenever a coin passes, a reset signal RE is produced and storage in the capacitors 33 and 35 is cleared.

Figure 3:
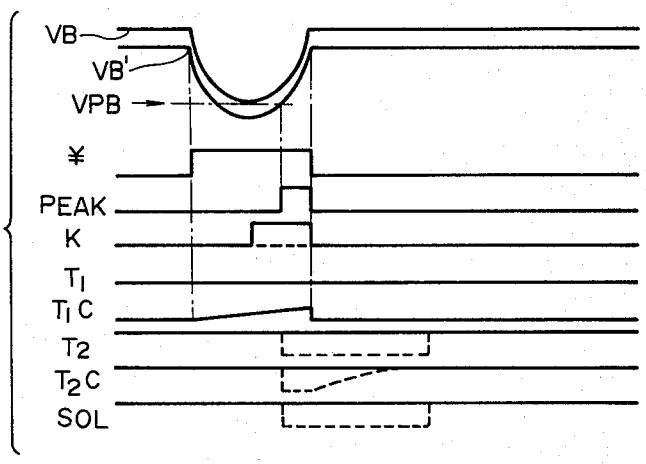
FIG. 3 is a graphical diagram showing examples of waveforms appearing in some component parts employed in the circuit shown in FIG. 2.

Reference voltages $V_1$ and $V_2$ of appropriate values are applied to comparators 25 and 26 and these comparators 25 and 26 produce an output "1" when the outputs of the detection and amplification circuits 19 and 20 are below the reference voltages $V_1$ and $V_2$. The outputs of the comparators 25 and 26 are delivered out as coin passing detection signals ¥ . The signal ¥ is produced whenever a coin has passed through the coin selection devices 11 and 12 no matter whether the coin is a true coin or a false coin. An example of the coin passing signal is shown in FIG. 3.

The comparator 27 receives at its input a peak value (i.e. the lowest value) voltage $V_{PB}$ stored in the capacitor 35. Examples of an attenuated output waveform $V_B$ provided by the detection and amplification circuit 20 in response to an inserted coin, and a waveform $V_B'$ which has been shifted in its level by the voltage dividing circuit 28, are shown in FIG. 3. The comparator 27 produces a peak signal PEAK when the level shifted waveform $V_B'$ is higher than the peak value voltage $V_{PB}$. As shown in FIG. 3, the peak signal PEAK rises with a slight delay from a time point when the attenuated waveform $V_B$ has reached the peak value (the lowest value) and in synchronism with a fall of the coin passing detection signal ¥ . This is because the reset signal RE is generated in synchronism with the fall of the signal ¥ in a coin acceptance control circuit 50, to be described below and the storage of the peak value $V_{PB}$ in the capacitor 35 thereby is cleared.

Voltages $V_{PA}$, $V_{RA}$, $V_{PB}$ and $V_{RB}$, having been stored in the capacitors 33–36, are applied to two window circuits 40 and 41. The window circuit 40 is a circuit for discriminating whether the inserted coin is true or false on the basis of the material of the coin. In the window circuit 40, the peak value voltage $V_{PA}$ is applied to a (−) input of a comparator 42; a (+) input of a comparator 43 and the standby mode voltage $V_{RA}$ is applied to a voltage dividing circuit consisting of resistances $R_1$, $R_2$ and $R_3$. The window circuit 41 is a circuit for discriminating whether the coin is true or false on the basis of the diameter of the coin. In the window circuit 41, the peak value voltage $V_{PB}$ is applied to a (−) input of a comparator 45; a (+) input of a comparator 46 and the standby mode voltage $V_{RB}$ is applied to a voltage dividing circuit consisting of resistances $R_4$, $R_5$ and $R_6$. The resistances $R_1$, $R_2$ and $R_3$ divide the standby mode voltage $V_{RA}$ to produce reference voltage $V_{RA1}$ and $V_{RA2}$ for the comparators 42 and 43. The voltage $V_{RA1}$ is greater than the voltage $V_{RA2}$. The voltage $V_{RA1}$ is applied to (+) input of the comparator 42 and the voltage $V_{RA2}$ to a (−) input of the comparator 43. The comparator 42 produces an output "1" when the voltage $V_{PA}$ is smaller than the voltage $V_{RA1}$, whereas the comparator 43 produces an output "1" when the voltage $V_{RA}$ is greater than the voltage $V_{RA2}$. The outputs of the comparators 42 and 43 are applied to an AND gate 44. When the peak value voltage $V_{PA}$ is between the two reference voltages $V_{RA1}$ and $V_{RA2}$, i.e., $V_{RA1} > V_{PA} > V_{RA2}$, the AND gate 44 produces an output "1". This signifies that the inserted coin has been judged to be a true coin as far as the material of the coin is concerned. Likewise, reference voltages $V_{RB1}$ and $V_{RB2}$ are obtained by dividing the standby voltage $V_{RB}$ by the resistances $R_4$, $R_5$ and $R_6$. The reference voltage $V_{RB1}$ is greater than the reference voltage $V_{RB2}$. An AND gate 47 produces an output "1" when the peak value voltage $V_{PB}$ is between the reference voltages $V_{RB1}$ and $V_{RB2}$, i.e., $V_{RB1} > V_{PB} > V_{RB2}$. This signifies that the inserted coin has been judged to be a true coin as far as the coin diameter is concerned. The outputs of the AND gates 44 and 47 are applied to an AND gate 48. Accordingly, the AND gate 48 produces an output "1" only when the inserted coin is a true coin both in its material and diameter.

The above described window circuits 40 and 41 and AND gate 48 can discriminate whether an inserted coin is true or false with respect to a single denomination. Accordingly, window circuits and an AND gate similar to the window circuits 40, 41 and the AND gate 48 are provided for each denomination and true coin detection signals $K_A$, $K_B$ and $K_C$ for respective denominations are applied to an OR gate 49. The output of the OR gate 49 is applied to the coin acceptance control circuit 50 as a signal indicating that the inserted coin is a true coin. The voltage dividing ratio of the voltage dividing circuit for obtaining the reference voltages $V_{RA1}$, $V_{RA2}$, $V_{RB1}$ and $V_{RB2}$ by dividing the standby voltages $V_{RA}$ and $V_{RB}$ is set at an optimum value which is different for each denomination. An example of the true coin detection signal K is shown in FIG. 3. If the inserted coin is a false coin, the true coin detection signal K remains at a "0" level.

In the coin acceptance control circuit 50, the true coin detection signal K is inverted by an inverter 51 and thereafter is applied to an AND gate 52. The AND gate 52 also receives the coin passing detection signal ¥ from the OR gate 39 and the peak signal PEAK from the comparator 27. Accordingly, the output of the AND gate 52 (a false coin detection signal S) becomes "1" when the inserted coin is a false coin and otherwise remains at a "0" level. The output of the AND gate 52 is applied to a NOR gate 53 and the output of the NOR gate 53 in turn is applied to a timer 54. This timer 54 is provided for delaying rise of an output $T_2$ thereof by a time interval determined by resistors $R_7$ and a capacitor $C_1$ from the rise of the output of the NOR gate 53 from "0" to "1". More specifically, the output of the NOR gate 53 is applied to one input of an AND gate 60 and also to the other input of the AND gate 60 after being delayed by a circuit including an amplifier 61, the resistance $R_7$ and the capacitor $C_1$. The AND gate 60 thereupon produces the timer output $T_2$. This timer output $T_2$ is provided as a solenoid control signal SOL through an amplifier 55. When the solenoid signal SOL is "1", a solenoid (not shown) provided for actuating the pin 13 is arranged to withdraw the pin 13 and thereby accept the coin inserted into the coin sorting device 14 as a true coin. When the signal SOL is "0", the solenoid is deenergized to cause the pin 13 to project into the coin path and thereby return the coin to the return path 15.

The output $T_2$ of the timer 54 is inverted by an inverter 56 and an inverted output $\overline{T_2}$ is applied to an AND gate 57. The AND gate 57 also receives the coin passing detection signal ¥ . This signal $\overline{T_2}$ is "1" when the signal SOL is "0", i.e., during a coin return mode. The output of the AND gate 57 is applied to a NOR gate 53.

The coin passing detection signal ¥ is inverted by an inverter 58 and thereafter is applied to an OR gate 59. The OR gate 59 also receives the signal $\overline{T_2}$ which is the inverted output signal of the timer 54. The output of the OR gate 59 is utilized as the reset signal RE for clearing the capacitors 33 and 35. Accordingly, the reset signal RE is generated during times other than when the coin is passing through the coin selection devices 11 and 12 or during the coin return mode in which the pin 13 is projecting in the coin path.

The coin passing detection signal ¥ is applied also to a timer 62. The timer 62 includes an AND gate 63 to which the signal ¥ is applied, an amplifier 64 for delaying the rise of the signal ¥ , resistance $R_8$ and a capacitor $C_2$. The voltage of the capacitor $C_2$ is applied to the other input of the AND gate 63. The time constant of the resistance $R_8$ and the capacitor $C_2$ is set to be longer than time interval which the coin passing detection signal ¥ can normally takes so that the output $T_1$ of the AND gate 63 rises to "1" in the case where the time interval of the signal ¥ is longer than usual. The output $T_1$ in the case where the time interval of the signal ¥ is normal remains "0". This signal $T_1$ is applied to the NOR gate 53.

The NOR gate 53 produces an output "1" if all of the three input signals thereto (i.e., $T_1$, S and the output of the AND gate 57) are "0" and produces an output "0" if any one of the three inputs is "1". The output $T_2$ of the timer 54 is "0" when the output of the NOR gate 53 is "0" and during the time interval in which the output of the NOR gate 53 rises from "0" to "1" (i.e., time interval determined by the time constant of the resistance $R_7$ and the capacitor $C_1$). When the output $T_2$ is "0", the signal SOL is "0" and the pin 13 thereby is caused to project into the coin path, resulting in shifting to the coin return mode. States of the pin 13 are summarized into the following Table 1:

TABLE 1

| State | Signal SOL | pin 13 |
|---|---|---|
| Standby | "1" | withdraw (coin accepted) |
| True coin | remaining "1" | same as above |
| false coin | "0" for specific time | project (coin returned) |
| power off | "0" | same as above |

In Table 1, the standby state (mode) is a state in which the electric power of the device is on but no coin has been inserted yet. In the standby state, the coin passing detection signal ¥ is "0" and, accordingly, the signal $T_1$, the output of the AND gate 57 and the signal S are all "0" and the output of the NOR gate 53 remains at "1". The solenoid control signal SOL therefore remains at be "1" and the pin 13 thereby is in its withdrawn position to accept an inserted coin. In the case where the electric power is off, the solenoid control signal SOL is "0" so that the pin 13 projects into the coin path to return the inserted coin.

Upon insertion of a coin, the signal ¥ rises to "1". At the moment the signal ¥ has risen, the signals $T_1$ and $\overline{T_2}$ are still "0" and, accordingly, the output of the NOR gate 53 is determined by the false coin detection signal S. If the inserted coin is a true coin, the true coin detection signal K rises to "1" as shown by a solid line in FIG. 3 and the output of the inverter 51 therefore is inverted to "0". Hence, the AND gate 52 is not enabled even if the peak signal PEAK subsequently rises to "1" and the false coin detection signal S remains "0". Accordingly, if the inserted coin is a true coin, the solenoid signal SOL remains at "1" with the pin 13 remaining withdrawn and allowing the coin, which has passed through the coin selection devices 11 and 12, to be led to the coin sorting device 14.

If the inserted coin is a false coin, the true coin detection signal K remains "0" as is shown by a broken line in FIG. 3, and the output of the inverter 51 remains "1". When the peak signal PEAK has risen to "1", the AND gate 52 is enabled and the false coin detection signal S is switched to "1". This causes the output of the NOR gate 53 to fall to "0" and the output $T_2$ of the AND gate 60 to fall to "0", as shown by a broken line in FIG. 3. When the false coin has passed the coin selection devices 11 and 12, the signal ¥ is switched to "0" resulting in switching of the output of the NOR gate 53 to "1". Switching of the output of the NOR gate 53 from "0" to "1" brings the timer 54 into operation, voltage $T_2C$ of the capacitor $C_1$ gradually rising as shown by a broken line in FIG. 3. When the voltage $T_2C$ reaches a preset threshold level, the AND gate 60 is enabled to turn the signal $T_2$ to "1". Accordingly, the signal $T_2$ rises to "1" with a delay equivalent to the operation time of the timer 54 as shown by a broken line in FIG. 3. The solenoid is deenergized while the signal $T_2$ is "0" so that the pin 13 projects into the coin path to lead the inserted false coin to the coin return path 15.

If the time interval of the coin passing signal ¥ is abnormally long, the signal $T_1$ rises to "1", and, even if the false coin detection signal S is "0" (i.e., the inserted coin is a true coin), the solenoid control signal SOL becomes "0" thereby bringing about the coin return mode. A typical case where the signal $T_1$ rises to "1" is blocking of a coin in the coin selection device 11 or 12.

In a normal state, the voltage $T_1C$ of capacitor $C_2$ does not rise so much and the signal $T_1$ remains at a "0" level.

The timer 54 is provided for returning all coins inserted after a false coin in case a plurality of coins have been thrown into the coin slot in rapid succession at an abnormally short time interval. For this purpose, an AND gate 57 is provided in combination with the timer 54. Once the timer 54 is brought into operation upon detection of a false coin, the signal $\overline{T_2}$ remains at "1" during the operation time of the timer 54 and insertion of a coin during the operation time of the timer 54 (i.e., subsequently to the insertion of the false coin) causes the signal ¥ to be switched to "1", enabling the AND gate 57 and thereby turning the output of the NOR gate 53 to "0" to reset the timer 54. Accordingly, if coins are successively inserted after the false coin at an extremely short interval (i.e., at an interval shorter than the operation time of the timer 54), the signal $T_2$ remains at "0" so that the coins successively inserted after the false coin are all returned, notwithstanding that the inserted coins are true coins. If coins inserted in rapid succession are all true coins, the timer 54 does not operate at all so that all of the inserted coins are accepted without being returned.

The voltage dividing circuit (the resistances $R_1$, $R_2$ and $R_3$ or $R_4$, $R_5$ and $R_6$) for producing the reference voltages may be composed of variable resistors. By composing the voltage dividing circuit of variable resistors, a simple adjustment of the variable resistors will be sufficient for adjusting to changes in the material or diameter of coins which may take place in future. The circuit for storing the standby mode voltage (the circuit portion including component parts 30, 34, 37 or 32, 36, 38) may be composed of an integration circuit of a large time constant (to such a degree that the attenuation period in the level of a received signal in passing of a coin can be disregarded). In the above described embodiment, the time constants of the capacitors 34, 36 and 37, 38 should also be sufficiently large.

As will be apparent from the description hereinabove, according to the invention, the reference voltages used for comparison with the coin detection outputs are not of a fixed value but are variable in accordance with variation in the level of a received signal in the standby mode and, accordingly, discrimination of coins can be effected accurately without being affected by irregularity in the level of the received signal which is caused by error in assembling of the detection and amplification circuit or change in the ambient temperature.

Further, the device according to the invention is capable of accepting all coins inserted in rapid succession except in a case where a false coin is included in the successively inserted coins in which case the inserted coins are returned. Accordingly, all true coins can be accepted however short the interval between insertion of the coins may be. This improves the efficiency of the vending machine and presents an erroneous operation of the machine.

What is claimed is:

1. A coin selection device comprising:

a signal oscillating coil and a signal receiving coil disposed on both sides of a coin path, respectively;

an amplifier circuit for detecting and amplifying an output of said signal receiving coil;

a comparator circuit for comparing an output of said amplifier circuit with a reference voltage to provide a detection signal representative of whether or not a coin is false;

a first memory circuit for storing the peak value in level of an output of said signal receiving coil provided when a coin passes through said coin path;

a second memory circuit for storing an output voltage of said amplifier circuit provided when said device is in standby mode;

a voltage division circuit for subjecting said output voltage stored in said second memory circuit to voltage division to apply a resultant voltage division output as said reference voltage to said comparison circuit;

wherein said second memory circuit includes at least a capacitor and a resistor whose time constant is relatively large, said second memory circuit being adapted to store the steady level of the output voltage of said amplifier circuit; and further comprising a reset circuit for resetting said first memory circuit whenever a coin passes through said coin path and after said coin has passed through said coin path.

2. A coin selection device comprising:

coin selecting means for detecting whether or not a coin inserted into said device is acceptable;

coin transferring means for transferring a coin inserted to a reception side or to a return side selectively;

first timer means which starts delay operation thereof in response to detection of an acceptable coin after said coin selecting means has detected an unacceptable coin;

control means for controlling said coin transferring means in such a manner that said transferring means transfers a coin inserted to said return side while said first timer means is in delay operation and said transferring means transfers a coin inserted to said reception side after the delay operation of said first timer means has been accomplished; and means which, when a coin is inserted into said device while said first timer means is carrying out delay operation, renews a delay time set in said first timer means, to continue a coin returning operation.

3. A device as claimed in claim 2, which further comprises second timer means set to a delay time substantially equal to a shortest time interval allowable in inserting coins successively into said device.

4. In a coin selection device having a signal oscillating coil and a signal receiving coil respectively disposed on both sides of a coin path, a detection and amplification circuit for detecting and amplifying an output of said signal receiving coil, a comparator circuit for comparing an output of said detection and amplification circuit with a reference voltage to provide a detection signal representative of whether or not a coin passing through said coin path is false, and a first memory circuit for storing the peak value of the output of said signal receiving coil during a period when the coin passes through said coil path, said coin selection device further comprising:

second memory circuit means for storing an output voltage of said detection and amplification circuit only during a period when said device is in a standby mode in which no coin has passed through said coin path for at least a predetermined time, and voltage division circuit means for dividing said output voltage stored in said second memory circuit according to a predetermined ratio to apply the divided voltage to said comparator circuit as said reference voltage, whereby coin selection can be performed accurately without being affected by irregularities such as variation in ambient temperature and power supply voltage, and further comprising:

coin transferring means for transferring a coin inserted to a reception side or to a return side selectively;

first timer means which starts delay operation thereof in response to detection of an acceptable coin after said coin selecting means has detected an unacceptable coin;

control means for controlling said coin transferring means in such a manner that said transferring means transfers a coin inserted to said return side while said first timer means is in delay operation and said transferring means transfers a coin inserted to said reception side after the delay operation of said first timer means has been accomplished;

means which, when a coin is inserted into said device while said first timer means is carrying out delay operation, renews a delay time set in said first timer means, to continue a coin returning operation; and a reset circuit for maintaining said first memory circuit reset while said first timer means is providing an output to transfer a coin inserted to said return side.

5. In a coin selection device having a signal oscillating coil and a signal receiving coil respectively disposed on both sides of a coin path, a detection and amplification circuit for detecting and amplifying an output of said signal receiving coil, a comparator circuit for comparing an output of said detection and amplification circuit with a reference voltage to provide a detection signal representative of whether or not a coin passing through said coin path is false, and a first memory circuit for storing the peak value of the output of said signal receiving coil during a period when the coin passes through said coil path, said coin selection device further comprising:

second memory circuit means for storing an output voltage of said detection and amplification circuit only during a period when said device is in a standby mode in which no coin has passed through said coin path for at least a predetermined time, and voltage division circuit means for dividing said output voltage stored in said second memory circuit according to a predetermined ratio to apply the divided voltage to said comparator circuit at said reference voltage, whereby coin selection can be performed accurately without being affected by irregularities such as variation in ambient temperature and power supply voltage, and further comprising:

a reset circuit for resetting said first memory circuit whenever a coin passes through said coin path and after said coin has passed through said coin path.

* * * * *